US006165108A

United States Patent [19]

Ralston

[11] Patent Number: 6,165,108

[45] Date of Patent: Dec. 26, 2000

[54] FEMININE PERSONAL TRAINER

[75] Inventor: Russell Ralston, Selma, Ala.

[73] Assignee: Dipstop, Inc., Selma, Ala.

[21] Appl. No.: 09/228,661

[22] Filed: Jan. 12, 1999

[51] Int. Cl.[7] ..... A63B 21/002

[52] U.S. Cl. ..... 482/91; 482/105; 482/148

[58] Field of Search ..... 482/91, 114, 124, 482/148, 105, 93; 601/136, 137, 138, 23, 45, 68; 606/191; 600/38, 41

[56] References Cited

U.S. PATENT DOCUMENTS

| | | | |
|---|---|---|---|
| D. 272,945 | 3/1984 | Suhel et al. | D24/214 |
| 2,763,265 | 9/1956 | Waters | 606/191 |
| 3,675,642 | 7/1972 | Lord | 600/32 |
| 4,240,412 | 12/1980 | James | 601/23 |
| 4,241,912 | 12/1980 | Mercer et al. . | |
| 4,307,716 | 12/1981 | Davis . | |
| 4,574,791 | 3/1986 | Mitchener . | |
| 4,881,526 | 11/1989 | Johnson et al. . | |
| 4,895,363 | 1/1990 | Plevnik et al. . | |
| 5,213,557 | 5/1993 | Firth . | |
| 5,554,092 | 9/1996 | Harpstead et al. . | |
| 5,690,603 | 11/1997 | Kain | 600/38 |
| 5,782,745 | 7/1998 | Benderev | 600/30 |
| 5,865,715 | 2/1999 | Wallick | 482/124 |

*Primary Examiner*—Justine R. Yu

*Attorney, Agent, or Firm*—Robert J. Veal; Robert M. Jackson; Burr & Forman, LLP

[57] ABSTRACT

An apparatus and method for exercising and improving the muscle tone of the feminine pelvic floor muscles utilizing an elongated vaginal insert having enlarged rounded ends and a substantially reduced cross-sectional middle portion. The ends of the apparatus are of different sizes in order to facilitate different levels of exercise, thus giving the apparatus a disproportional hourglass shape. The enlarged ends gradually reduce in circumference proximate the middle portion of the apparatus, thus creating two inclined surfaces

13 Claims, 5 Drawing Sheets

FEMININE PERSONAL TRAINER

FIELD OF THE INVENTION

The present invention relates to the field of medical exercise devices used to strengthen muscles such that particular medical complications are managed or avoided. More particularly, the present invention relates to devices used to exercise and strengthen the feminine perivaginal muscles. In even greater particularity, the present invention relates to a vaginal insert for exercising and strengthening the perivaginal muscles. With even further particularity, the present invention relates to a vaginal insert for exercising and strengthening the perivaginal muscles which requires no external actuation during use of the device.

BACKGROUND OF THE INVENTION

The perivaginal muscle structure consists primarily of two separate and distinct muscle groups, the sphincter muscles and the pelvic floor or pubococcygeus (PC) muscles. The PC muscles are elongated strands of muscle extending between the inner regions of the pelvic bone, supporting the perimeter of the vagina. This particular muscle configuration is commonly referred to in the medical community as having the appearance of hammocks having the ends attached to the pelvic bone inner perimeter while the middle portion of the hammocks overlays the exterior perimeter of the vagina. The sphincter muscles and the PC muscles operate in conjunction to constrict the opening and closing of the urethra, vagina, and rectum. When the pelvic floor muscle tone is good, these openings are properly maintained and constricted by virtue of the tightness of the muscles surrounding the respective openings. However, numerous factors cause or significantly contribute to the deterioration of the perivaginal muscle structure and the subsequent enlarging and relaxing of the aforementioned openings. The primary factors contributing to weakened perivaginal muscle structure are childbirth, over medicating, poor physical conditioning, auto accidents, surgical procedures, progressive illnesses, and atrophy associated with aging.

The deterioration of the perivaginal muscles contributes to a number of medical conditions including uterine prolapse, fallen bladder, fallen rectum, cystitis, difficulties with voiding, decreased sexual comfort, chronic vaginal and lower back discomfort, and various forms of incontinence. Many of these medical conditions are curable only through heavy medication or costly and painful surgery; however, proper perivaginal muscle tone has been shown to significantly reduce the occurrences of many of the above mentioned medical conditions. Although simply maintaining proper perivaginal muscle tone is an effective method for reducing numerous medical conditions associated with the deterioration of the perivaginal muscles, it appears that the public is unwilling to utilize the current methods and apparatuses for strengthening these particular muscles, as 10 to 35% of female adults suffer from various forms of medical conditions associated with perivaginal muscle deterioration. Incontinence in particular, plagues over 13 million Americans and over one half of the nursing home residents in the United States. These numbers clearly represent the need for a simple device used to exercise and strengthen the perivaginal muscles.

Numerous intravaginal devices for exercising and strengthening the perivaginal muscles have been disclosed in the relevant art, including U.S. Pat. No. 4,895,363, which teaches a Set Of Parts And Methods For Testing And/Or Strengthening The Pelvic Floor Muscles comprising a plurality of cone shaped vaginal inserts having various weights. Utilization of the method disclosed includes insertion of one of the cones, typically a lighter cone first, and attempting to retain the cone within the vagina. If the cone can be retained, it should be replaced with a heavier one until maintaining the cone within the vagina is not easily accomplished. This cone then represents the proper exercise cone to start with. Actual exercising of the pelvic floor muscles involves complete insertion of the cone and contracting the muscles such that the cone is urged inward and upward. This action exercises the muscles when it is repeated. However, this method and apparatus are difficult to properly utilize, as the insert can become lost or lodged within the vagina, improperly placed such that the pelvic floor muscles are not even exercised, and is somewhat psychologically difficult to utilize given these negative possibilities.

Another device disclosed in the relevant art is U.S. Pat. No. 4,241,912 for an Isometric Vaginal Exercise Device And Method. This device utilizes a rounded shaft having flange and handle attached to one end for manipulation, a concave portion of the shaft is positioned proximate the flange such that the diameter of the shaft decreases proximate the flange and then increases to a maximum value as the distance from the flange increases, and the shaft terminates in a decreasing diameter rounded end. The device is inserted within the vagina with only a portion of the handle protruding from the vagina, such that the device can be manipulated by the user. The device is to be placed such that the perivaginal muscles are proximate the concave portion of the shaft, thereby facilitating gripping of the device by the particular muscles and allowing for exercise. Exercise is accomplished with this device through the movement of the pelvic floor muscles up and down on the rounded end of the device. The device remains stationary within the vagina. This device, in similar fashion to the previously mentioned apparatus, is again difficult to properly utilize given the possibility of improperly placing the device such that the perivaginal muscles are not properly exercised, along with the psychological difficulties associated with the use of the device.

Aside from vaginal exercise inserts, physicians have attempted to utilize medication in an attempt to cure the problems associated with poor perivaginal muscle strength. However, there are specific disadvantages associated with medication type cures also. These types of cures typically do not increase the strength of the relevant muscles, they only temporarily relieve the resulting symptoms associated with poor muscle strength. Medications for incontinence, for example, often offer only temporary relief to the patient until muscle strength can be restored through exercise. Incontinence medications, in addition to being only a temporary cure, can also further the symptoms by medically causing the muscles to further relax, thus reducing the urethra's ability to resist or maintain fluid flow.

Therefore, although numerous methods and devices currently exist for exercising the perivaginal muscles, the methods and devices currently used are seldom used properly or adhered to for a time period significant enough to benefit the patient. This is likely due to the physical shortcomings of the above mentioned devices, in addition to the inherent psychological objections involved with using any vaginally inserted device. The size, complexity, and methods of use of the devices currently in the art are certain to increase these objections, thus reducing the effectiveness of the devices. Additionally, the complexities involved with cleaning, transporting, and general use of these devices also hinder the effectiveness of the methods and devices. In order for the current devices to be effective, they must not only be regularly used for a significant period of time, typically three to six months, but they also require physician instruction in order to properly utilize the device.

SUMMARY OF THE INVENTION

It is the object of the present invention to provide a device for exercising and strengthening the feminine perivaginal muscles utilizing an inexpensive, reliable, and easily operated device. It is an additional object of the present invention to provide a perivaginal muscle exercise device which is easily used, cleaned, maintained, and transported, such that embarrassment and psychological objections of the user are minimized. These objects are accomplished through a reasonably sized and weighted hourglass shaped vaginal insert, which is used to exercise and strengthen the perivaginal muscles. It is a further object of the present invention to provide a method for exercising and strengthening the perivaginal muscles utilizing the aforementioned device.

BRIEF DESCRIPTION OF THE DRAWINGS

A device embodying the features of the present invention is depicted in the accompanying drawings, which form a portion of this disclosure, wherein.

DETAILED DESCRIPTION OF THE PREFERRED EMBODIMENT

Figure 1:
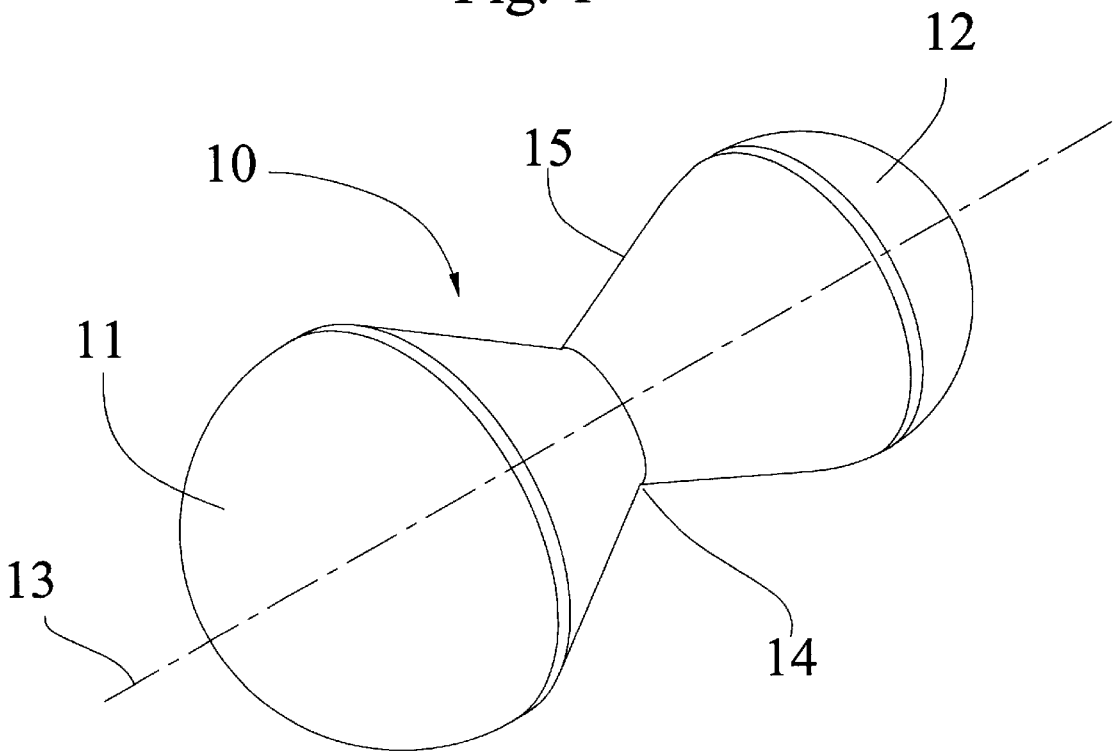
FIG. 1 is a perspective view of the device.
Figure 2:
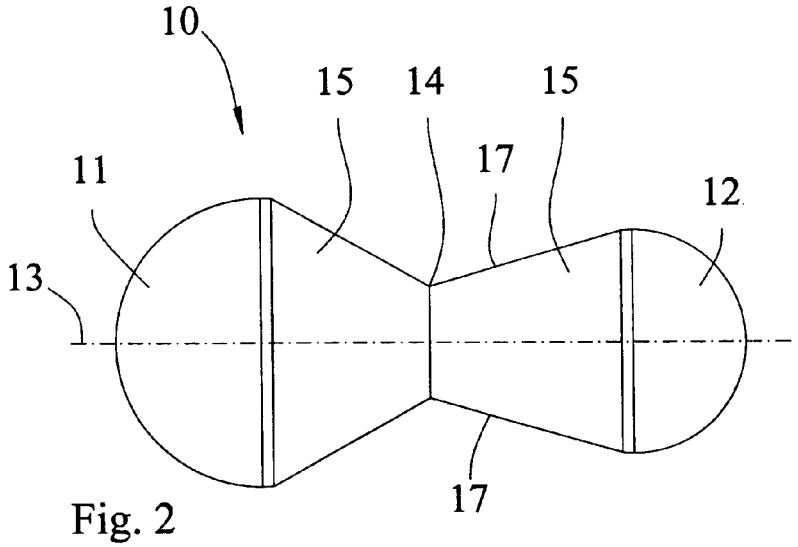
FIG. 2 is a view of the first embodiment of the device.
Figure 7:
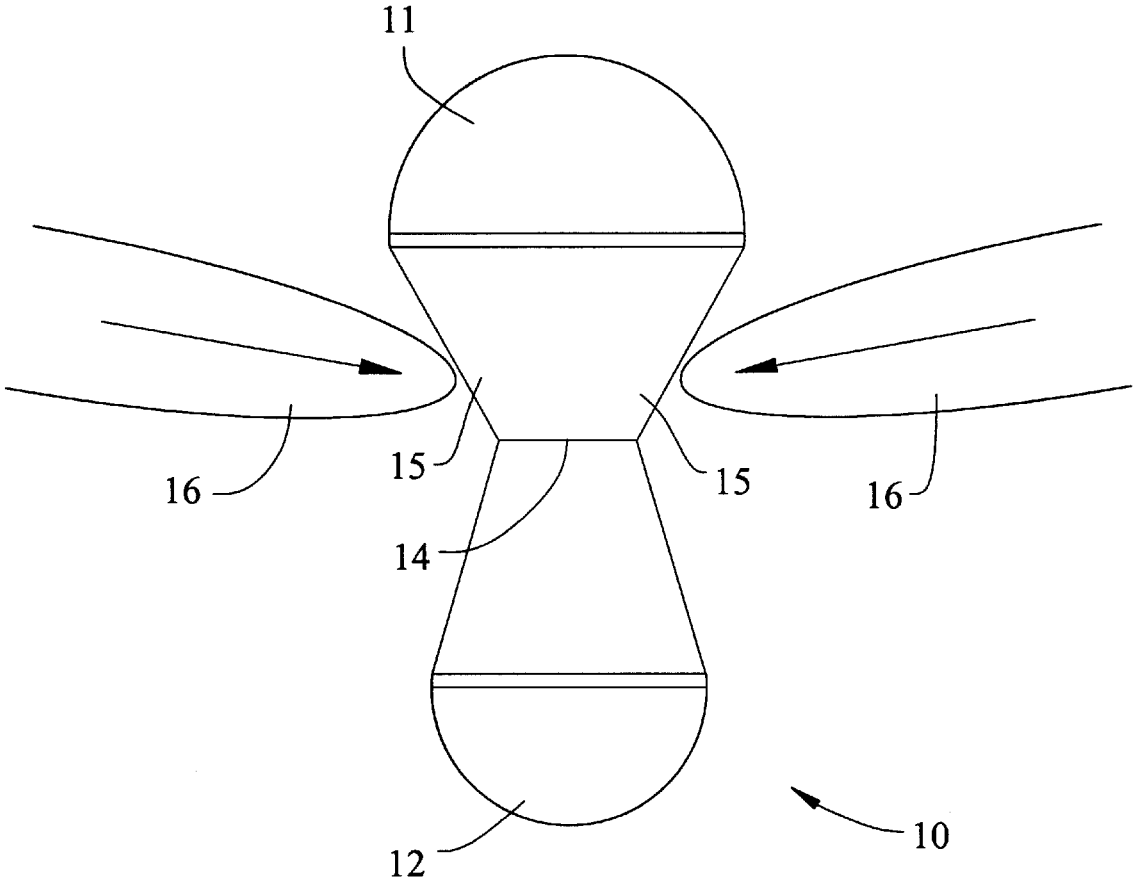
FIG. 7 is a view of the device engaged by the perivaginal muscles.
Figure 8:
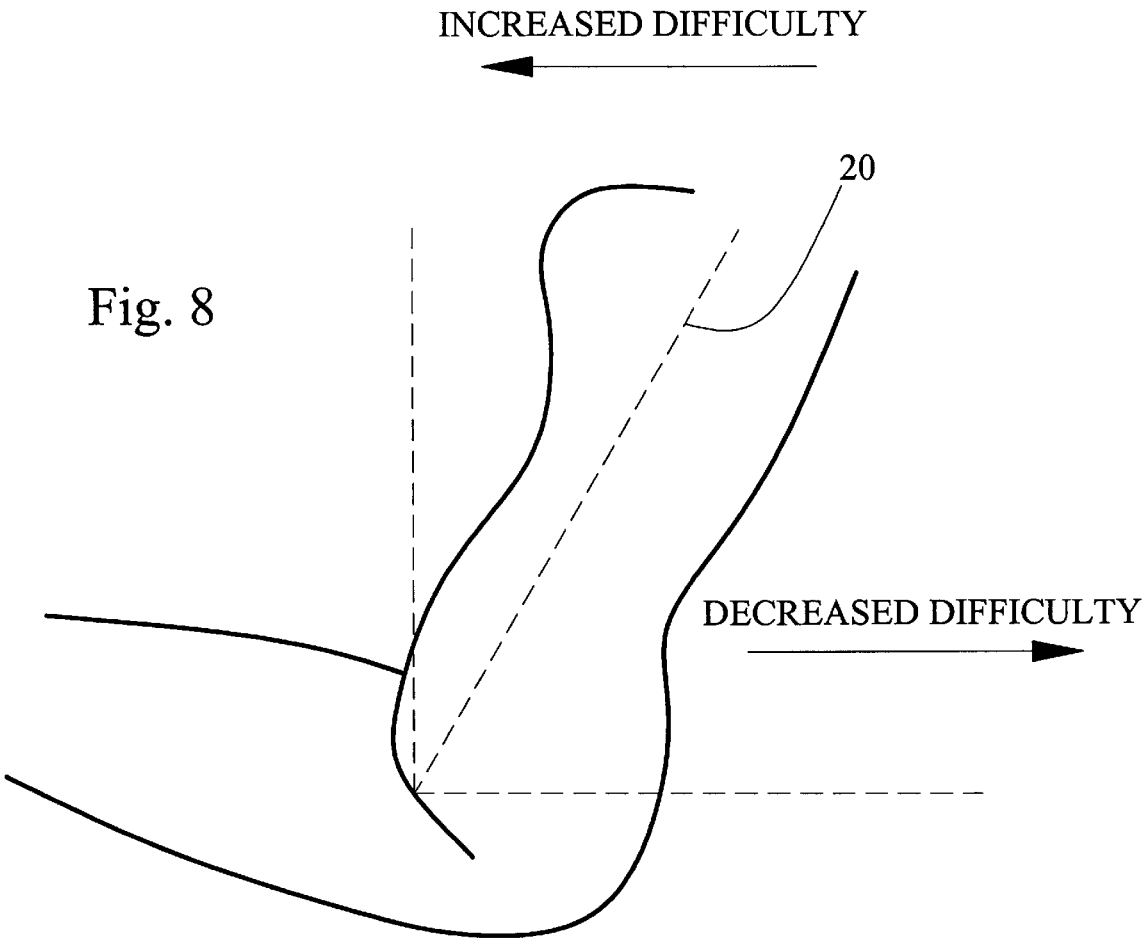
FIG. 8 is a view representing the varied torso position relative to exercise difficulty.

Referring to the drawings for a better understanding of the principles of operation and structure of the invention, it will be seen that FIG. 1 shows a general perspective view of the primary embodiment of the apparatus. The apparatus provides a vaginal exercise device having an elongated body 10 of a substantially round cross-sectional area of varying diameter along the axis 13 of the device. The exercise device has a first 11 and second ends 12, first end 11 being of larger circumference than second end 12. Both first end 11 and second end 12 being substantially round such that the effort and discomfort associated with vaginal insertion is minimized. First end 11 and second end 12 gradually decrease in circumference circumference along axis 13 of the device towards the middle portion 14, as shown in FIG. 2. This gradual decrease in circumference creates a first and second smooth inclined regions 15 proximate middle portion 14 of the device, which acts as the primary areas of contact with the perivaginal muscles 16 when the device is inserted within the vagina. Smooth inclined region 15 is substantially conic and clearly shown as a pair of diverging surfaces 17 in the two dimensional drawing. First and second smooth surfaces 15 also act to correctly position the device proximate PC muscles 16. This is essentially due to the unique shape of the apparatus, in that the gradual decrease in circumference of the device near middle portion 14 naturally encourages the PC muscles to locate the device in the proper exercise position, as shown in FIG. 7, when muscles 16 are initially contracted by the user. The initial contraction of PC muscles 16 will urge the device to move such that PC muscles 16 are positioned immediate the narrowest portion 14 of the device, leaving a portion of the opposing end exposed from the vagina. If the initial contraction of PC muscles 16 pushes the entire device out of the vagina, then the device was either not initially positioned properly, or the user forced the device out of the vagina via the abdominal muscles. If the device was positioned improperly, it simply must be inserted farther within the vagina for proper use. If the end opposing the insertion end of the device no longer exposed from the vagina upon completion of the initial contraction, then the device was positioned too far within the vagina and must be adjusted prior to commencing exercises.

The differential in size between first 11 and second ends 12 of the device acts to create two distinct levels of exercise difficulty for the user, along with comfortably accommodating varying sizes of vaginas. First end 11, the larger of the two, creates a lower level of difficulty than second smaller end 12, as larger end 11 is easier to pull or maintain within the vagina through contraction of PC muscles 16. Smaller end 12 is more difficult for PC muscles 16 to pull within as the hammock type muscles 16 must contract much tighter to urge smaller end 12 within the vagina.

Figure 3:
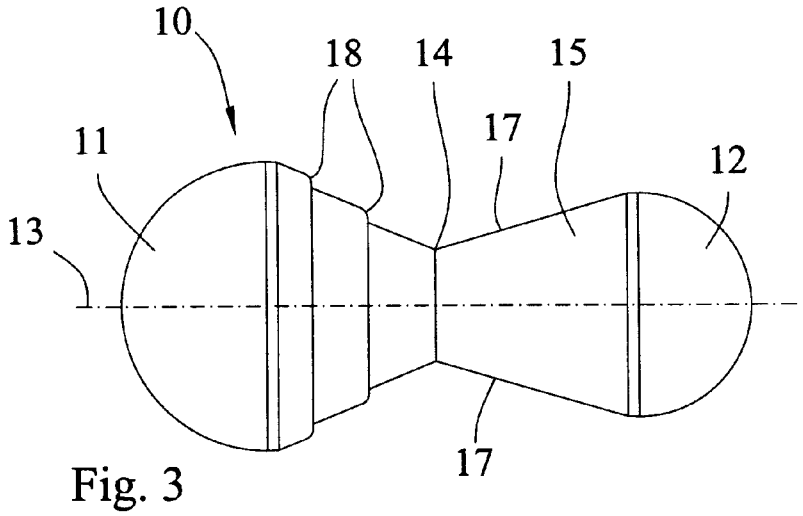
FIG. 3 is a view of the second embodiment of the device.

A second embodiment of the device is illustrated in FIG. 3. This embodiment is essentially the same as the first embodiment; however, first and second smooth inclined regions 15 are modified to include distinct reductions in circumference 18 such that smooth surface 15 will have rounded steps 18 reducing the circumference. Steps 18 act to both create graduations in the difficulty of the exercise and to ease in the proper location of the apparatus within the vagina. Steps 18 decreasing the circumference of the device creates a more difficult exercise as PC muscles 16 again must contract tighter in order to urge or maintain the device within the vagina. The distinct steps 18 also help to identify the correct positioning of the apparatus proximate PC muscles 16 as the user can feel distinct steps 18 in the device relative to contracting muscles 16 and adjust the position of the device accordingly such that the device is positioned proximate PC muscles 16 for optimal exercise.

Figure 4:
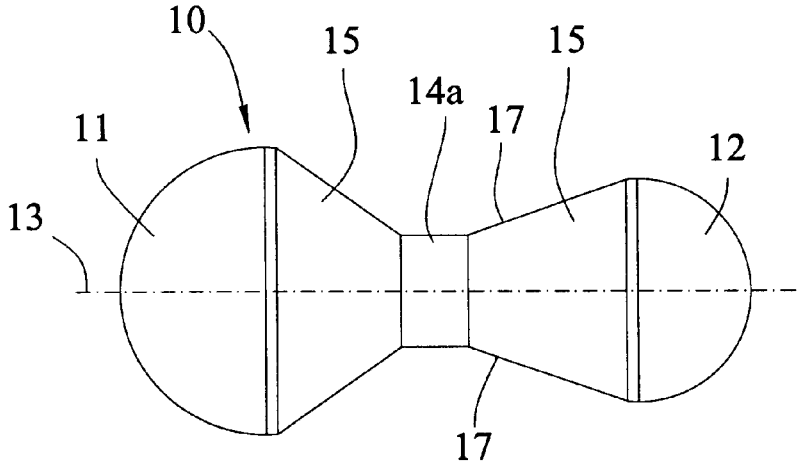
FIG. 4 is a view of the third embodiment of the device.

Another embodiment of the device is illustrated in FIG. 4. This embodiment incorporates a variation of middle portion 14 of the device. In this embodiment, middle portion 14 of the device includes a substantially narrow cylindrical cross-sectional area 14*a*, such that there is essentially a uniform diameter region in middle portion 14 of the device. This area again further facilitates proper positioning of the apparatus proximate PC muscles 16, as the substantially narrow cylindrical region 14*a* is where PC muscles 16 will naturally position themselves when contracted, thus properly positioning the device proximate PC muscles 16 for optimum exercising.

Figure 5:
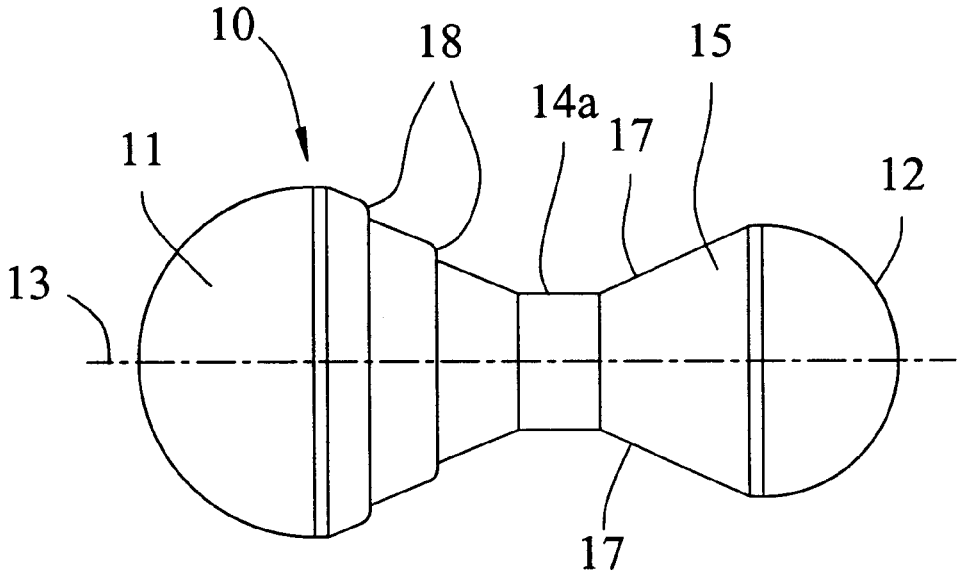
FIG. 5 is a view of the fourth embodiment of the device.

Another embodiment of the device is illustrated in FIG. 5. This embodiment incorporates the features of the previous two embodiments, those shown in FIG. 3 and FIG. 4, into a single embodiment. Thus, the current embodiment utilizes both steps 18 shown in FIG. 3, and cylindrical middle section 14*a*, as shown in FIG. 4. The incorporation of these two embodiments creates an embodiment with both a greater level of exercise difficulty variation and a functional design which allows for ease in property positioning the device proximate PC muscles 16.

Figure 6:
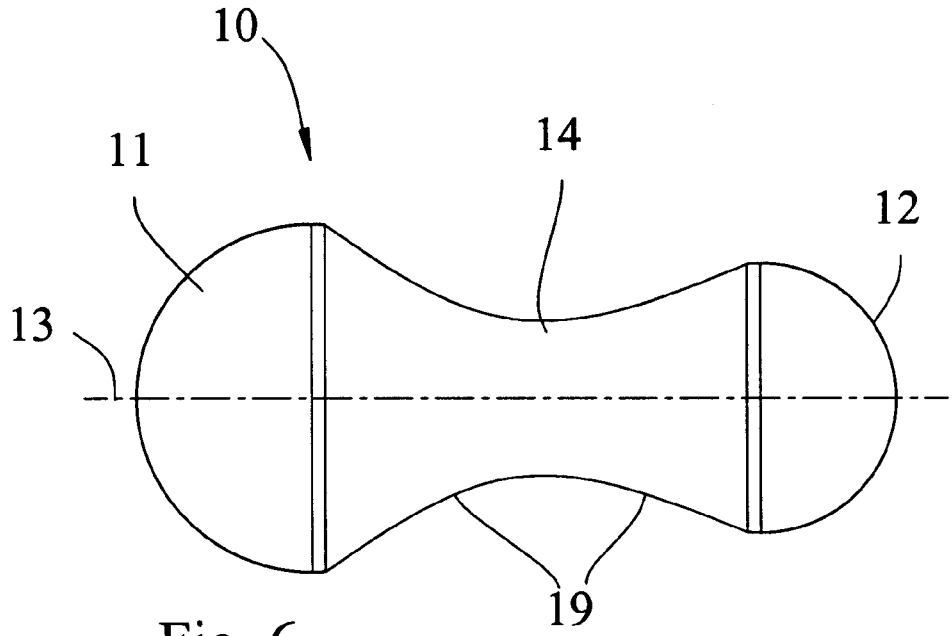
FIG. 6 is a view of the fifth embodiment of the apparatus.

A final embodiment is illustrated in FIG. 6. This embodiment incorporates the same primary features and advantages of the previous embodiments; however, this embodiment utilizes a somewhat varied configuration. In this embodiment, the substantially smooth 15 and conical regions 17 present in the previous embodiments are replaced with a smooth nonlinear taper 19. This smooth nonlinear taper 19 is essentially the three-dimensional solid formed by rotating an arc about longitudinal axis 13 of the device extending from approximately the point of maximum circumference of first end 11 and second end 12 to a point equidistant from first end 11 and second end 12 representing middle 14 of the device. The solids formed by these rotations creates smooth nonlinear surfaces 19 on middle portion 14 of the device, which are again easily gripped by perivaginal muscles 16 during use of the device for exercising.

Prior to using the device, the user must understand the proper positioning of the device such that PC muscles 16 are isolated and exercised. The proper positioning of the device proximate the PC muscles is clearly illustrated in FIG. 7. Upon proper positioning of the device, PC muscles 16 will be in contact with smooth inclined regions 15 of the device such that when PC muscles 16 are contracted, the device is urged upward and inward into the vagina. This movement is caused by the PC muscles contracting and urging the device to its point of least circumference, which is middle region 14. Repeated contractions of these muscles improve the muscle tone and strength, thus eliminating many of the problems associated with poor perivaginal muscle tone and strength.

The method of using the device to strengthen PC muscles 16 includes only a few simple steps, which will often create noticeable differences in muscle strength in approximately two to four weeks. Prior to exercising with the device, it should always be thoroughly cleaned using a mild soap and warm water. Once the device is cleaned, it should be inserted into the vagina by gripping the device on one of enlarged ends 11, 12 and inserting the device along its longitudinal axis 13 into the vagina. The device should be inserted only to the point where second end 11 or 12 is partially protruding from the vagina. Insertion to this point will properly position or seat the device such that PC muscles 16 are in contact with smooth inclined slopes 15 of the device. If insertion causes discomfort, a vaginal lubricant can be applied to the device to ease the insertion. Once the device is properly inserted, PC muscles 16 can gently be contracted such that the device is urged upward and inward into the vagina via PC muscles 16 contact with smooth inclined slopes 15. In order to efficiently develop PC muscle 16 tone and strength, a muscle contraction should be held for approximately six seconds, then released. Following this long contraction, the user should execute five shorter contractions in succession, holding the device for approximately one second upon each contraction. The combination of a long contraction with the five shorter contractions all together designates a set of exercise. A proper exercise routine would comprise multiple sets of exercise, which should increase in both difficulty and number with increasing muscle strength.

The device and method of operation additionally incorporates a number of ways to vary the exercise level of difficulty, along with a method for testing the muscle strength. The direction of insertion is the most obvious method of varying the level of difficulty of PC muscle 16 exercise. Insertion of the larger end 11 will create a mild level of difficulty, while insertion of the smaller end 12 will increase the level of difficulty. The difficulty level can also be varied through the position of the body during the exercise, as shown in FIG. 7. When the exercises are performed with the body substantially reclined, the axis of insertion 20 forms a lesser angle with horizontal, thus the level of difficulty is minimized as the device is not significantly urged away from the PC muscles by the weight of the device itself. However, when the exercises are performed with the body substantially upright, axis of insertion 20 is closest to 90 degrees, and thus the level of difficulty is significantly increased as weight of the device is attempting to urge the device directly down and away from PC muscles 16, thus greater muscle strength is necessary to maintain the device in position and to urge it upward and inward. Therefore, as shown in FIG. 7, the most difficult level of exercise will be when the body is positioned substantially upright during the exercise of PC muscles 16.

In order to determine either the exercise level of difficulty the progress of the user, a method of testing the muscle strength is also disclosed. The method includes inserting the device within the vagina using the normal insertion routine disclosed above. Upon insertion, the user can gradually stand up to a full and upright position. Once this position is obtained, the user should time how long the device can be maintained within the vagina. A longer time period denotes greater muscle strength. The substantial weight of the device, along with the substantially upright position, will cause the level of difficulty involved with maintaining the device within the vagina to be both maximized and constant, thus creating an accurate gauge for the progression of the muscle strength due to the exercises. Additionally, the method of testing can be utilized to determine the initial level of exercise difficulty.

It is to be understood that the form of the invention shown is a preferred embodiment thereof and that various changes and modifications may be made therein without departing from the spirit of the invention or scope as defined in the following claims.

I claim:

1. An article of manufacture for exercising and strengthening the feminine pelvic floor muscles utilizing controlled weight resistance without external actuation during use comprising a solid feminine training weight having an elongated body of a substantially round cross-sectional area of varying diameter along the longitudinal axis of the device including a middle portion having a reduced middle diameter, a substantially conic first end portion and a substantially conic second end portion, each said end portion flaring outwardly from said middle portion and transitioning to smooth round surfaces with the diameter of each said end portion increasing linearly along said longitudinal axis outwardly from said middle portion to a maximum diameter forming a substantially conic smooth inclined region between said middle portion and each said maximum diameter, the diameter of each said end portion decreasing along said longitudinal axis outwardly from each said maximum diameter to form a generally smooth rounded surface region terminating each said end portion wherein said conic first end portion and said conic second end portion have a longitudinal dimension greater than said transition.

2. An article of manufacture as defined in claim 1 wherein the diameter of each said end portion increases along said longitudinal axis outward y from said middle portion to a maximum diameter in a series of distinct steps forming a series of smooth inclined regions having linearly sloped sides between said middle portion and each said maximum diameter.

3. An article of manufacture as defined in claims 1 or 2 wherein said first end portion flares outward to a maximum diameter greater than the maximum diameter of said second end portion.

4. An article of manufacture as defined in claim 3 wherein the weight of said elongated body is at least 6 ounces, the length of said elongated body is at least 2.5 inches, the maximum diameter of said first end portion is at least 1.2 inches and not greater than 1.75 inches, and the maximum diameter of said second end portion is at least 0.9 inches and not greater than 1.3 inches.

5. An article of manufacture as defined in claims 1 or 2 wherein the weight of said elongated body is at least 6 ounces.

6. An article of manufacture as defined in claims 1 or 2 wherein the length of said elongated body is at least 2.5 inches.

7. An article of manufacture as defined in claims 1 or 2 wherein the maximum diameter of said end portions is at least 0.9 inches.

8. An article of manufacture as defined in claims 1 or 2 wherein said middle portion includes a cylindrical region having a substantially uniform middle diameter.

9. An article of manufacture as defined in claim 8 wherein the minimum length of said middle diameter is at least 0.5 inches and not greater than 0.75 inches.

10. A method of weight resistance exercise training for the feminine pelvic floor muscles utilizing a pelvic floor muscles training weight having an elongated body of a substantially round cross-sectional area of varying diameter along the longitudinal axis of said training weight, a middle portion having a reduced middle diameter, a Substantially conic first end portion and a substantially conic second end portion, each said end portion flaring outwardly from said middle portion to form a smooth inclined region having sloped sides and transitioning to smooth round surfaces wherein said conic first end portion and said conic second end portion have a longitudinal dimension greater than said transition, said method comprising the steps of:

a. gripping the first end portion of said training weight;

b. inserting the second end portion of said training weight along its longitudinal axis into the vagina such that the smooth inclined region of said second end portion is in contact with the pelvic floor muscles and the first end portion of said training weight is protruding from the vagina;

c. automatically placing said training weight in the proper exercise position by contracting the pelvic floor muscles against said smooth inclined region of said second end portion such that contraction of said pelvic floor muscles against the sloped sides of said smooth inclined region causes the training weight to be lifted or urged upward and inward into the vagina;

d. executing a set of pelvic floor muscles weight training exercises by repeatedly contracting the pelvic floor muscles for selected durations such that said training weight is repeatedly lifted or urged upward and inward into the vagina, held in such a lifted position for the duration of the contraction, and allowed to return to the original insertion position by partially relaxing said perivaginal muscles; and, e. repeating the execution of said set of pelvic floor muscles weight training exercises as necessary to maintain or increase strength in said pelvic floor muscles.

11. The method of exercise training for the pelvic floor muscles as recited in claim 10, further comprising the step of adjusting the exercise level of difficulty by changing the direction of insertion of said training weight wherein said first end portion of said training weight is inserted along its longitudinal axis into the vagina such that the smooth inclined region of said first end portion is in contact with the pelvic floor muscles and the second end portion of said training weight is partially protruding from the vagina with said first end portion being a different size than said second end portion.

12. The method of exercising training for the pelvic floor muscles as recited in claim 10, further comprising the step of adjusting the resistance of said training weight and resulting exercise level of difficulty by adjusting the angle of inclination of the torso during use, ranging from a maximum level of difficulty achieved with the torso substantially upright, with gravity attempting to urge the weight training device down and away from the pelvic floor muscles, to a minimum level of difficulty achieved with the torso substantially reclined.

13. The method of exercise training for the pelvic floor muscles as recited in claim 10, further comprising inserting the weight training device with the user in a substantially reclined position, maintaining a contraction of the pelvic floor muscles and the weight training device within the vagina for as long as possible as the user gradually stands up to a substantially upright position, the duration of said maintaining being an indicator of the progression of muscle strength or the initial level of exercise activity.

* * * * *